United States Patent [19]

Sano

[11] Patent Number: 4,586,416

[45] Date of Patent: May 6, 1986

[54] RHYTHM GENERATING APPARATUS OF AN ELECTRONIC MUSICAL INSTRUMENT

[75] Inventor: Shigenori Sano, Tokyo, Japan

[73] Assignee: Casio Computer Co., Ltd., Tokyo, Japan

[21] Appl. No.: 644,665

[22] Filed: Aug. 27, 1984

Related U.S. Application Data

[63] Continuation of Ser. No. 367,914, Apr. 13, 1982, abandoned.

[30] Foreign Application Priority Data

Apr. 20, 1981 [JP] Japan ..... 56-58425
Apr. 20, 1981 [JP] Japan ..... 56-58426
Apr. 20, 1981 [JP] Japan ..... 56-58427

[51] Int. Cl.[4] ..... G10H 1/40; G10H 1/46

[52] U.S. Cl. ..... 84/1.03; 84/1.27; 84/DIG. 12; 331/78

[58] Field of Search ..... 84/1.01, 1.03, DIG. 12, 84/1.27; 331/78

[56] References Cited

U.S. PATENT DOCUMENTS

| | | | |
|---|---|---|---|
| 4,181,059 | 1/1980 | Weber | 84/DIG. 12 |
| 4,205,575 | 6/1980 | Hoskinson et al. | 84/1.01 |
| 4,208,938 | 6/1980 | Kondo | 84/1.03 |
| 4,263,828 | 4/1981 | Aoki et al. | 84/1.03 |
| 4,291,386 | 9/1981 | Bass | 331/78 X |
| 4,333,374 | 6/1982 | Okumura et al. | 84/1.01 |
| 4,336,736 | 6/1982 | Mishima | 84/1.03 X |

FOREIGN PATENT DOCUMENTS 52-99807 8/1977 Japan .

*Primary Examiner*—S. J. Witkowski
*Attorney, Agent, or Firm*—Frishauf, Holtz Goodman & Woodward

[57] ABSTRACT

Rhythm sound data which represents a rhythm sound such as a percussion sound, is synthesized with envelope data by a gate circuit which functions as a multiplier. The synthesized data is supplied to a D/A converter and converted to an analog signal. A percussion sound with a rhythm pattern corresponding to the analog signal is produced at a speaker.

7 Claims, 19 Drawing Figures

RHYTHM GENERATING APPARATUS OF AN ELECTRONIC MUSICAL INSTRUMENT

This application is a continuation of application Ser. No. 367,914, filed Apr. 13, 1982, and now abandoned.

BACKGROUND OF THE INVENTION

The present invention relates to a rhythm generating apparatus for an electronic musical instrument, which generates rhythm sounds like a percussion sound through digital signal processing.

In an electronic musical instrument, a rhythm generating apparatus is used to generate rhythm sounds like a percussion sound in an analog manner. However, the analog rhythm generating apparatus is complex and large in size. A compact electronic musical instrument which, is compact in size and light in weight thus can hardly be manufactured with such analog apparatus. Various attempts have been made to provide the rhythm generating apparatus in the form of a digital circuit. As an example, in Japanese Patent Disclosure No. 52-99,807/1977 published on Aug. 22, 1977, a rhythm generating apparatus generates digital waveform memory address signals corresponding to sounds of various kinds of instruments of percussion. An analog percussion signal is directly read out from a waveform memory. Therefore, the waveform memory has a relatively large capacity so that the sound generating circuit can hardly be arranged in an LSI. The rhythm generating apparatus thus remains large in size.

A rhythm generating apparatus for generating percussion sounds generally has a circuit for generating a noise type rhythm signal, which comprises a circuit for generating a noise signal and a circuit for producing a sound like a sound produced by cymbals by applying an envelope on the noise signal, and a circuit for generating a sine wave type rhythm signal to obtain a sound like a bass drum. The circuit for generating the noise type rhythm signal generally includes a multiplier which multiplies the noise signal by the envelope signal. As is well known, a digital multiplier is complicated and large in size, resulting in high cost.

Similarly, the circuit for generating the sine wave type rhythm signal includes a multiplier which multiplies the sine wave signal by the envelope signal. In general, an envelope signal generator and an envelope control circuit are arranged in the sine wave type rhythm signal generator and in the noise type rhythm signal generator, respectively. However, a piece of music rarely has a rhythm pattern simultaneously including the sine wave type percussion sound and the noise type percussion sound. In practice, the envelope signal generator and the envelope control circuit need not, therefore, be arranged in both rhythm signal generators.

Even if a plurality of rhythm sounds are involved with a musical performance, the same envelope waveform can be used and supplied to the rhythm signal generators without causing any trouble in the actual musical performance.

Further, in a conventional rhythm generating apparatus for generating more than two rhythm patterns, the volume of each rhythm sound is set to be constant, resulting in monotonous performance as compared with a musical performance by natural musical instruments. Thus, a rich musical expression can not be obtained.

SUMMARY OF THE INVENTION

It is an object of the present invention to provide a rhythm generating apparatus of an electronic musical instrument which generates a rhythm sound like a percussion sound through digital signal processing and which is suitable for arranging in an LSI.

It is another object of the present invention to provide a rhythm generating apparatus of an electronic musical instrument wherein a circuit for applying an envelope to a rhythm signal generated from a rhythm signal generator does not have a digital multiplier, so that the overall arrangement may be simplified and may be manufactured at low cost.

It is still another object of the present invention to provide a rhythm generating apparatus of an electronic musical instrument which has a single envelope generator commonly used for a plurality of rhythm sound generators to decrease circuit space and manufacturing cost.

It is still another object of the present invention to provide a rhythm generating apparatus of an electronic musical instrument which is capable of controlling a volume ratio of a plurality of rhythm sounds by a simple digital circuit.

BRIEF DESCRIPTION OF THE DRAWINGS

FIGS. 12A and 12B to FIGS. 14A and 14B are timing charts for explaining different modes of operation of the embodiment shown in FIG. 10, respectively.

DETAILED DESCRIPTION OF THE PREFERRED EMBODIMENTS

Rhythm generating apparatuses according to embodiments of the present invention will be described with reference to the accompanying drawings.

Figure 1:
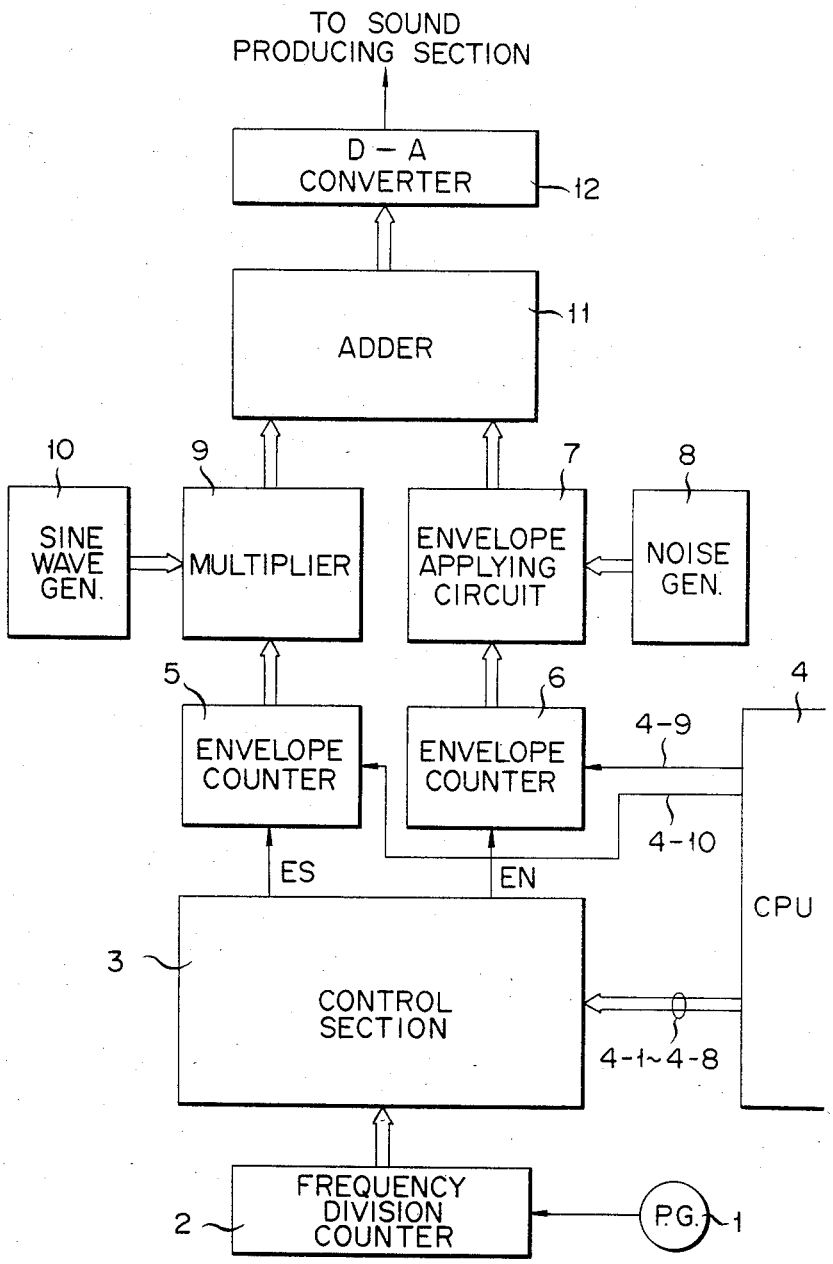
FIG. 1 is a block diagram of a rhythm generating apparatus according to one embodiment of the present invention.

FIG. 1 shows a rhythm generating apparatus for simultaneously generating two kinds of rhythm sounds by noise data and sine wave data according to one embodiment of the present invention.

An output from a pulse generator (PG) 1 is supplied to a frequency division counter 2. An output from the frequency division counter 2 is then supplied to a control section 3. The control section 3 also receives control signals from a CPU 4. These control signals vary with the kinds of rhythm patterns and rhythm sounds. Envelope clock pulses EN and ES are generated from the control section 3.

Figure 2:
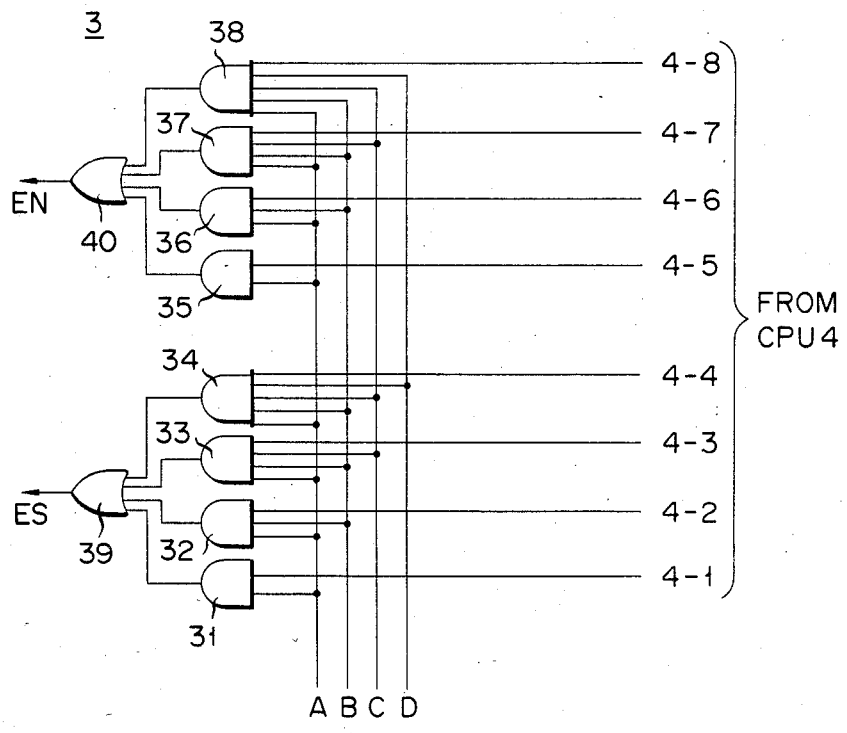
FIG. 2 is a circuit diagram of a control section shown in FIG. 1.

FIG. 2 is a circuit diagram of the control section 3. The output from the frequency division counter 2 is 4-bit data comprising input signals A to D which correspond to the least significant bit A to the most significant bit D. The input signal A is supplied to AND gates 31 to 38. The input signal B is supplied to the AND gates 32 to 34 and 36 to 38. The input signal C is supplied to the AND gates 33, 34, 37 and 38. The input signal D is supplied to AND gates 34 and 38.

Gate control signals are respectively supplied from the CPU 4 to the AND gates 31 to 38 through lines 4-1 to 4-8. Outputs from the AND gates 31 to 34 are supplied as the envelope clock pulse ES to an envelope counter 5 through an OR gate 39. Outputs from the AND gates 35 to 38 are supplied as the envelope clock pulse EN to an envelope counter 6 through an OR gate 40.

In order to generate the envelope clock pulse ES of highest frequency, a gate signal of level "1" is supplied to the AND gate 31 through the line 4-1, while gate signals of level "0" are supplied to the AND gates 32 to 34 through the lines 4-2 to 4-4, respectively. However, in order to generate the envelope clock pulse ES of lowest frequency, a gate signal of level "1" is supplied to the AND circuit 34 through the line 4-4, while gate signals of level "0" are supplied to the AND gates 31 to 33 through the lines 4-1 to 4-3.

The envelope clock pulse EN is controlled in the same manner as the envelope clock pulse ES. If the lines 4-5 to 4-8 are at "0" level, the envelope clock pulse EN is not generated. Thus, a noise type sound is not produced as will be described in detail later. If the lines 4-1 to 4-4 are at "0" level, the envelope clock pulse ES is not generated. Thus, a sine wave type sound is not produced.

As described above, the envelope clock pulses ES and EN are supplied to the envelope counters 5 and 6, respectively.

Figure 3:
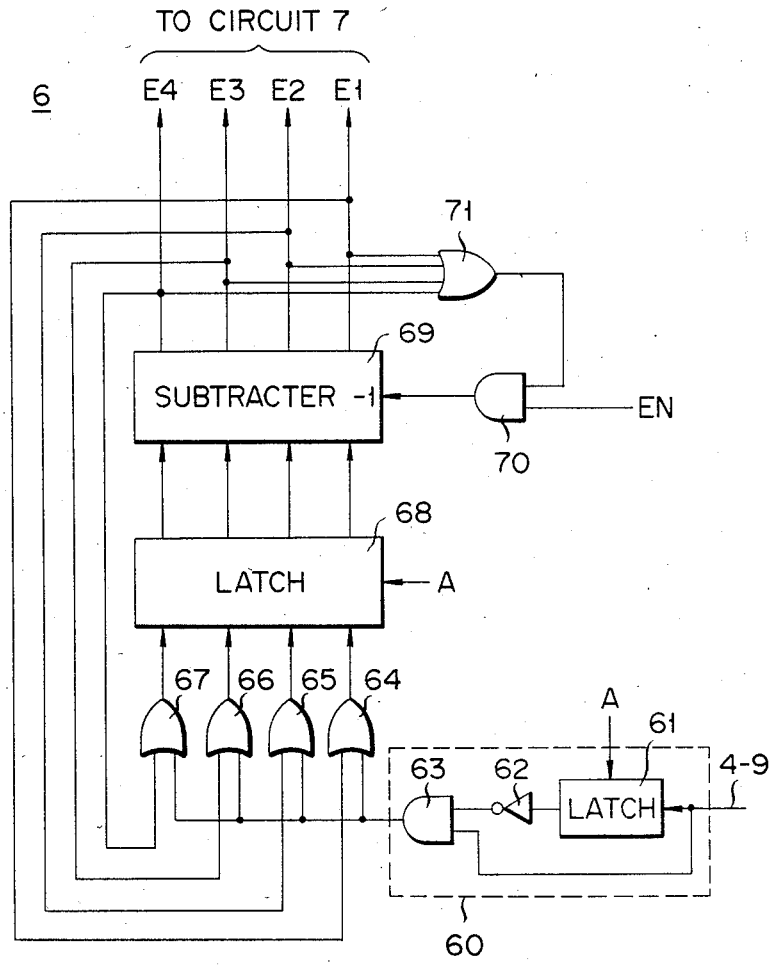
FIG. 3 is a circuit diagram of an envelope counter shown in FIG. 1.

Based on the frequencies of the envelope clock pulses ES and EN, the envelope counters 5 and 6 produce data for controlling an envelope of the sine wave type rhythm sound signal and data for controlling an envelope of the noise type rhythm sound signal, respectively. Since the envelope counters 5 and 6 are identical, only the envelope counter 6 will be described with reference to FIG. 3. At a timing at which a corresponding rhythm sound is generated, a one-shot signal of level "1" is supplied to a one-shot circuit 60 from the CPU 4 through a line 4-9.

The one-shot circuit 60 comprises a latch 61, an inverter 62, and an AND gate 63. The latch 61 latches data in response to an output A from the frequency division counter 2. The one-shot circuit 60 generates a one-shot signal of level "1" at a timing of the leading edge of the signal supplied through the line 4-9. The one-shot signal of level "1" from the one-shot circuit 60 is supplied to OR gates 64 to 67. Outputs from the OR gates 64 to 67 are latched in a latch 68 every time the output A from the counter 2 is supplied to the latch 68. Outputs from the latch 68 are supplied to a subtracter 69. The count values of the subtracter 69 are decremented every time the envelope clock pulse EN is supplied from the control section 3 thereto. Then, the subtracter 69 supplies envelope data E1 to E4 of 4 bits to an envelope applying circuit 7.

The subtracter 69 receives the outputs from the latch 68 and the envelope clock pulse EN at a "−1" input terminal through an AND gate 70. The AND gate 70 receives an output from an OR gate 71 which receives the envelope data E1 to E4. Therefore, when all envelope data E1 to E4 are set to level "0", the envelope clock pulse EN is not supplied to the subtracter 69.

The outputs from the subtracter 69 are supplied to the latch 68 through the OR gates 64 to 67. In this manner, the envelope data E1 to E4 are held until the envelope clock pulse EN is supplied to the subtracter 69.

The envelope counter 5 which has the same arrangement as the envelope counter 6 is operated by a signal supplied from the CPU 4 through a line 4-10 and the envelope clock pulse ES. The obtained envelope data is supplied to a multiplier 9.

Noise data from a noise generator 8 is supplied to the envelope applying circuit 7 and superposed by the output from the envelope counter 6. As a result, data including envelope data is then supplied to an adder 11. The multiplier 9 receives sine wave data from a sine wave generator 10. The sine wave data is multiplied by the output from the envelope counter 5 and the resultant data is supplied to the adder 11.

The noise generator 8 includes a shift register and an exclusive OR gate. The sine wave generator 10 reads out the sine wave data stored in a ROM in response to a clock pulse of a predetermined frequency. The sine wave generator 10 may generate a sine wave signal by superposing rectangular wave signals.

Figure 4:
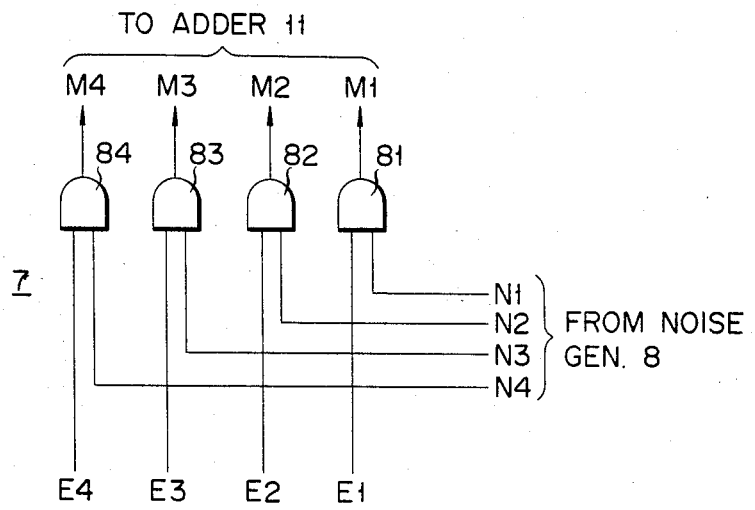
FIG. 4 is a circuit diagram of an envelope applying circuit shown in FIG. 1.

The multiplier 9 may be in the form of a known multiplier. The envelope applying circuit 7 has a simple arrangement as shown in FIG. 4.

Four-bit noise data N1 to N4 are supplied from the noise generator 8 to AND gates 81 to 84. The AND gates 81 to 84 also receive the envelope data E1 to E4 from the envelope counter 6. If the envelope data is large, noise data is maintained at high level. However, if the envelope data is attenuated, the level of the noise data is lowered gradually.

An adder 11 adds the output from the envelope applying circuit 7 and the output from the multiplier 9. The sum signal is supplied to a D/A converter 12 which converts the digital signal to an analog signal. This analog signal is supplied to an amplifier (not shown) and a speaker (not shown) of a sound producing section, and a predetermined rhythm sound is produced thereat.

Figure 5:
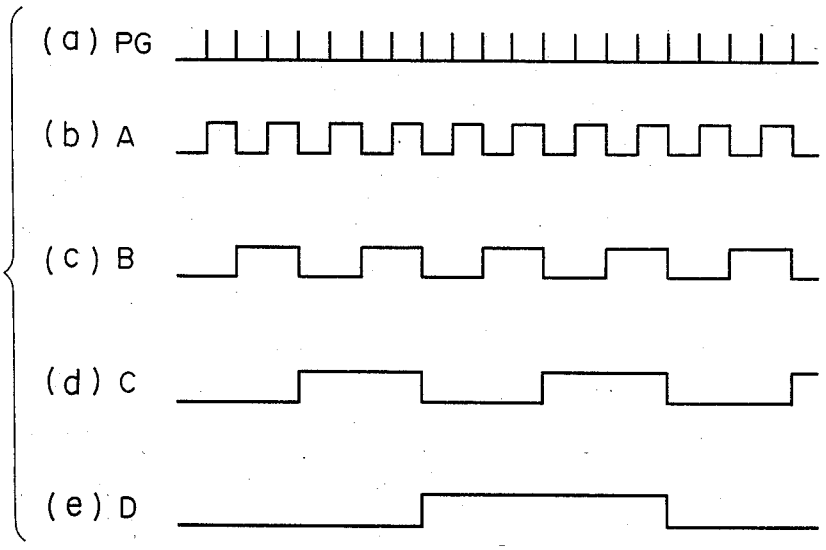
FIG. 5 shows a timing chart for explaining the operation of a frequency division counter shown in FIG. 1.
Figure 6:
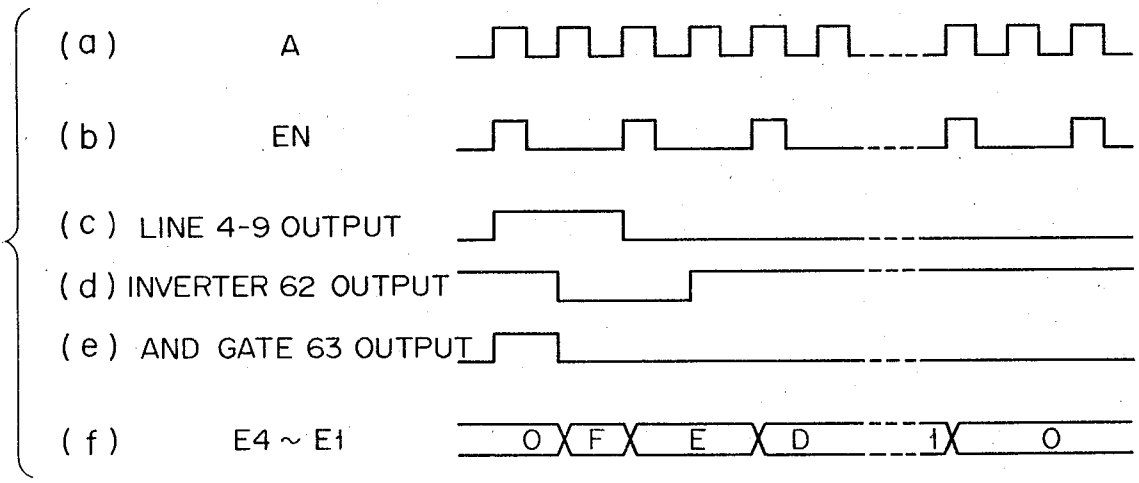
FIG. 6 shows a timing chart for explaining the operation of the envelope counter shown in FIG. 3.

The mode of operation of the rhythm generating apparatus according to the first embodiment of the present invention will be described. The pulse generator 1 generates a clock pulse of the waveform shown in FIG. 5(*a*). When the clock pulse is supplied to the frequency division counter 2, the frequency division counter 2 generates the signals A to D of the waveforms shown in FIGS. 5(*b*) to 5(*e*). Assume that a gate signal of level "1" is supplied from the CPU 4 to the control section 3 through the line 4-6 while the gate signals of level "0" are supplied thereto through lines 4-5, 4-7 and 4-8. FIG. 6(*a*) shows the output signal A of the frequency division counter as has been shown in FIG. 5(*b*). Every time the output signal A is generated twice, the envelope clock pulse EN is generated once from the control section 3, as shown in FIG. 6(*b*). When a signal of level "1" of the waveform shown in FIG. 6(*c*) is supplied through the line 4-9 to the envelope counter 6, an output from the inverter 62 is inverted as shown in FIG. 6(*d*). As a result, the AND gate 63 generates the one-shot signal of the waveform shown in FIG. 6(*e*). The envelope data E4 to E1 outputted from the subtracter 69 are sequentially decremented from binary coded data "1111" (=F in the hexadecimal notation) by one every time the envelope clock pulse EN is outputted.

Figure 7A:
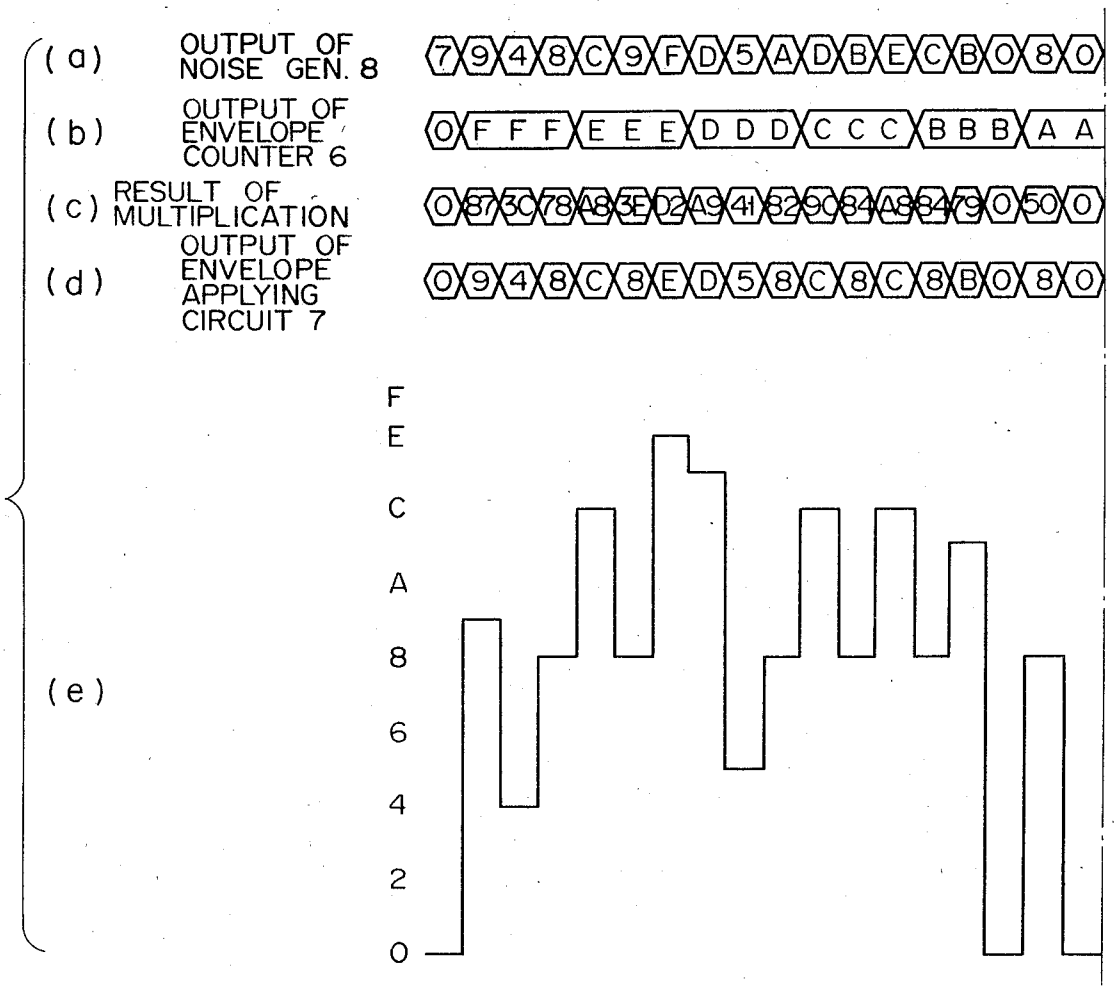
FIGS. 7A and 7B show a timing chart for explaining the operation of the rhythm generating apparatus according to one embodiment of the present invention as shown in FIG. 1.
Figure 7B:
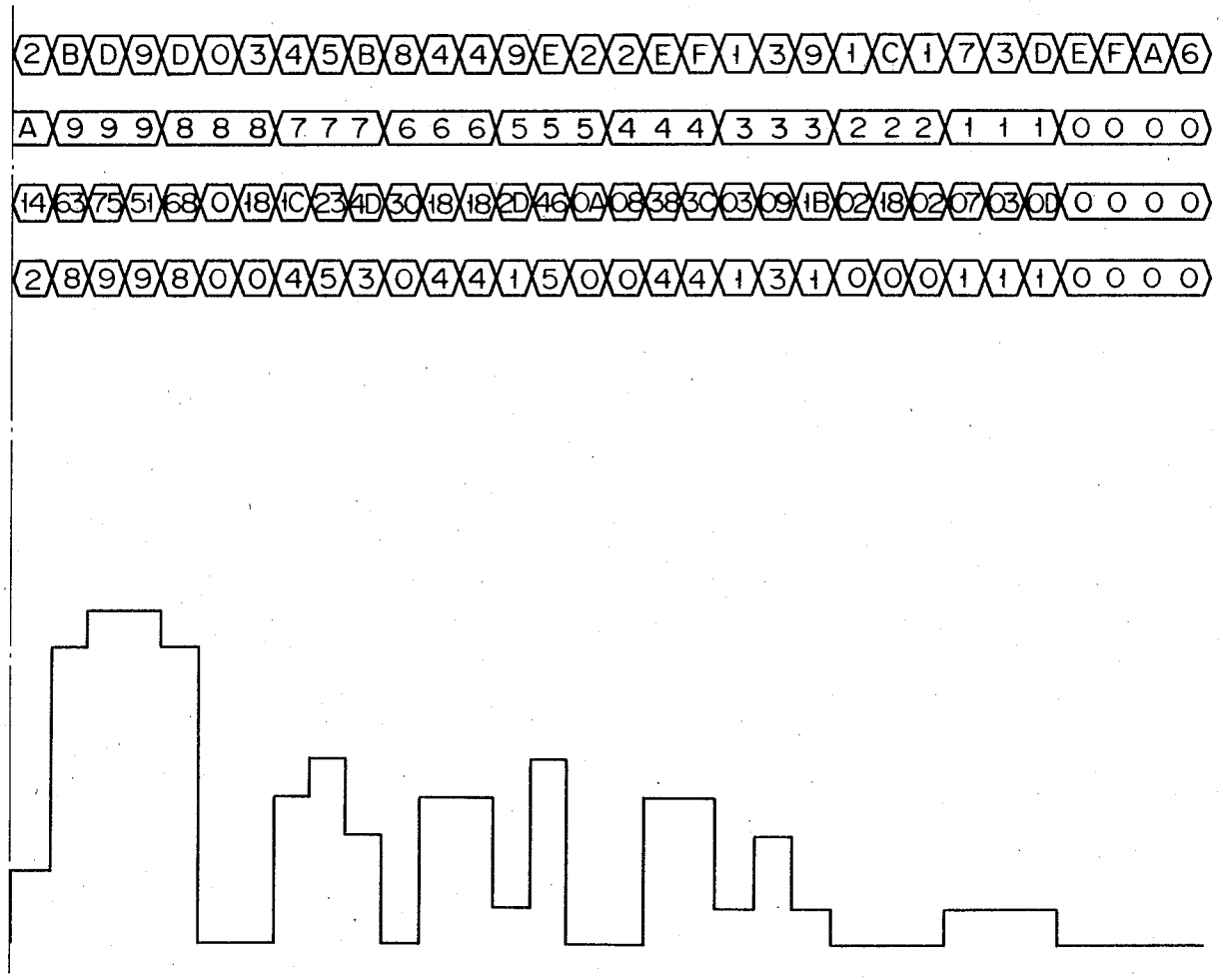

Simultaneously, noise data of 4 bits which is shown in (a) in FIGS. 7A and 7B is sequentially generated from the noise generator 8. The noise data is supplied to the envelope applying circuit 7 shown in FIG. 4. If binary coded data for the envelope is "1010", the AND gate 82 and 84 are ON and the AND gates 81 and 83 are OFF.

The output from the envelope applying circuit 7 is changed, as shown in (d) in FIGS. 7A and 7B. The output of level "0" from the multiplier 9 and the output from the envelope applying circuit 7 are added in the adder 11. In other words, the data which is the sum of the noise data and the envelope data is output from the adder 11 and supplied to the D/A converter 12. Thus, an analog signal of the waveform shown in (e) in FIGS. 7A and 7B is obtained.

The rhythm sound which is the sum of the noise data and the envelope data, attenuating gradually from the time when the one-shot signal of level "1" is supplied from the CPU 4 through the line 4-9, is thus produced. Shown in (c) in FIGS. 7A and 7B is the accurate multiplication result when the conventional digital multiplier multiplies the output from the noise generator 8 as shown in (a) in FIGS. 7A and 7B by the output from the envelope counter 6 as shown in (b) in FIGS. 7A and 7B. In this case, a rhythm sound having an envelope which is gradually attenuated and which is added to the noise data, can be obtained. However, the circuit shown in FIG. 4 is simpler than the circuit described above.

In order to produce simultaneously the rhythm sound of sine wave type data and the rhythm sound of noise type data, one-shot signals of level "1" are supplied from the CPU 4 through the lines 4-9 and 4-10. In this case, the output from the multiplier 9 and the output from the envelope applying circuit 7 are added in the adder 11. The envelope which is gradually attenuated is superposed on the sine wave type data. This sine wave type data is synthesized with the noise data to produce a rhythm sound. Therefore, various rhythm sounds can be produced in accordance with various types of envelope and with a mixing ratio of the noise signal and the sine wave signal.

In the above embodiment, the envelope applying circuit 7 comprises AND gates. However, the circuit 7 may comprise OR gates and exclusive OR gates or a combination thereof to provide a multiplication function.

Further, in the above embodiment, a case is described in which two kinds of rhythm sound, noise type and sine wave type rhythm sounds are produced. However, in order to produce a plurality of rhythm sounds, the circuit shown in FIG. 1 may be operated on a time division basis.

Further, in the above embodiment, the rhythm sound is produced by adding the sine wave data and noise data by the adder 11. However, these data may be synthesized by another arithmetic operation. A waveform data to be synthesized by the noise data may be saw-tooth waveform data, square waveform data, pulse waveform data or other periodic function waveform data.

As described above, a method for controlling the envelope of the noise sound in an electronic musical instrument with a very simple circuit is provided, so that the circuit space is reduced greatly as compared with conventional circuit design. The circuit can be properly arranged in the form of an LSI, resulting in low cost.

Figure 8:
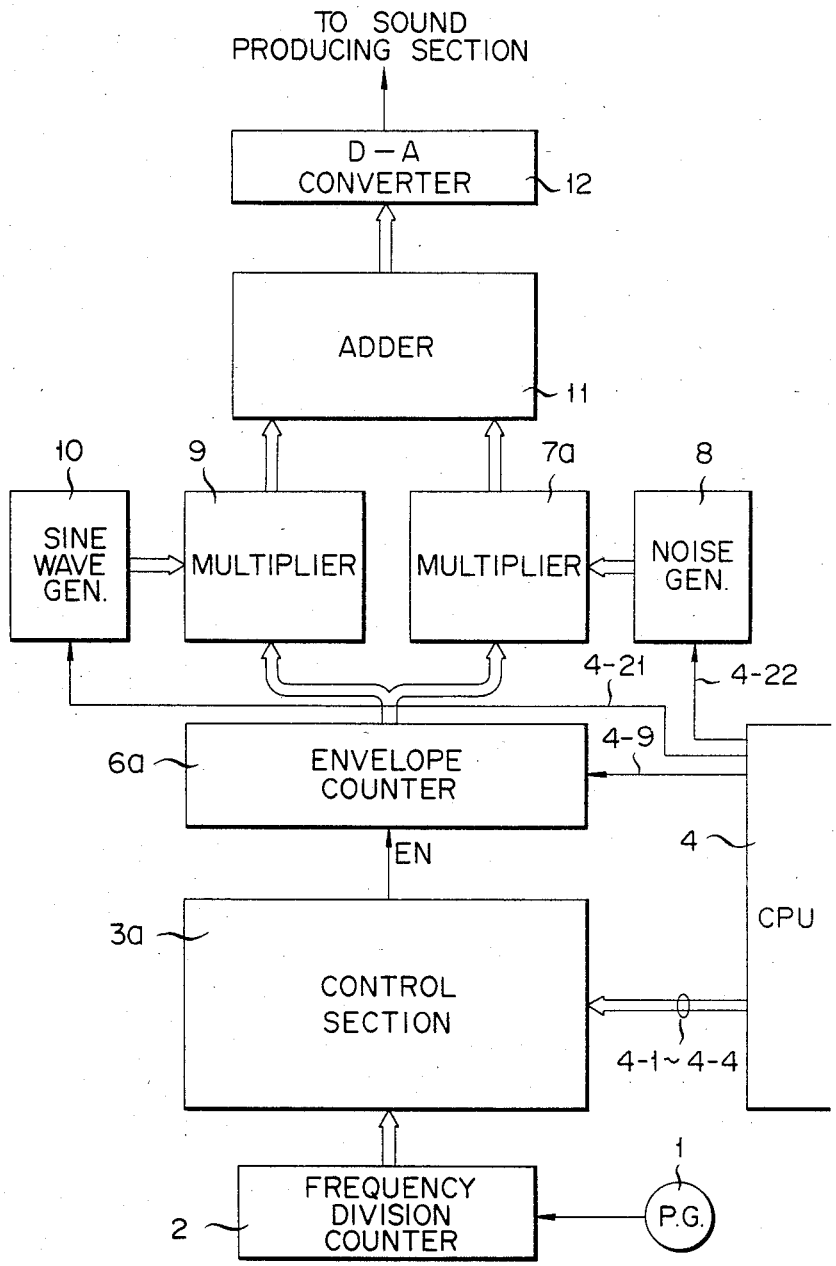
FIG. 8 is a block diagram of a rhythm generating apparatus according to another embodiment of the present invention.

FIG. 8 shows a rhythm generating apparatus according to a second embodiment of the present invention. The same or like reference numerals as in FIG. 1 denote the corresponding parts in FIG. 8. Referring to FIG. 8, 4-bit control signals are supplied from the CPU 4 to a control section 3*a* through the lines 4-1 to 4-4. The control section 3*a* supplies the envelope clock pulse EN to an envelope counter 6*a*. Therefore, the arrangement of the control section 3*a* corresponds to the upper half of the control circuit 3 shown in FIG. 2. The outputs from the CPU 4 through the lines 4-1 to 4-4 in place of the lines 4-5 to 4-8 are supplied to the AND gates 35 to 38.

The envelope clock pulse EN is supplied from the control section 3*a* to the envelope counter 6*a*. The envelope counter 6*a* has the same arrangement as the envelope counter 6 shown in FIG. 3, except that the outputs E1 to E4 from the subtracter 69 are commonly supplied to a multiplier 7*a* and the multiplier 9 in place of the envelope applying circuit 7. The multipliers 7*a* and 9 may be constituted by the gate circuit 7 shown in FIG. 4. Alternatively, known digital multipliers may be used as the multipliers 7*a* and 9.

Noise data is supplied from the noise generator 8 to the multiplier 7*a*. The noise data is multiplied by the output from the envelope counter 6*a* and the resultant data is supplied to the adder 11. The multiplier 9 receives sine wave data from the sine wave generator 10. The sine wave data is multiplied by the output from the envelope counter 6*a* and the resultant data is supplied to the adder 11.

A selection signal is supplied from the CPU 4 to the sine wave generator 10 through a line 4-21, while a selection signal is supplied from the CPU 4 to the noise generator 8 through a line 4-22. These selection signals are supplied when the sine wave type rhythm sound or the noise type rhythm sound is selected. In order to produce these rhythm sounds simultaneously, both selection signals are simultaneously supplied from the CPU 4 through the lines 4-21 and 4-22.

The mode of operation of the rhythm generating apparatus according to the second embodiment shown in FIG. 8 will be described.

Figure 9A:
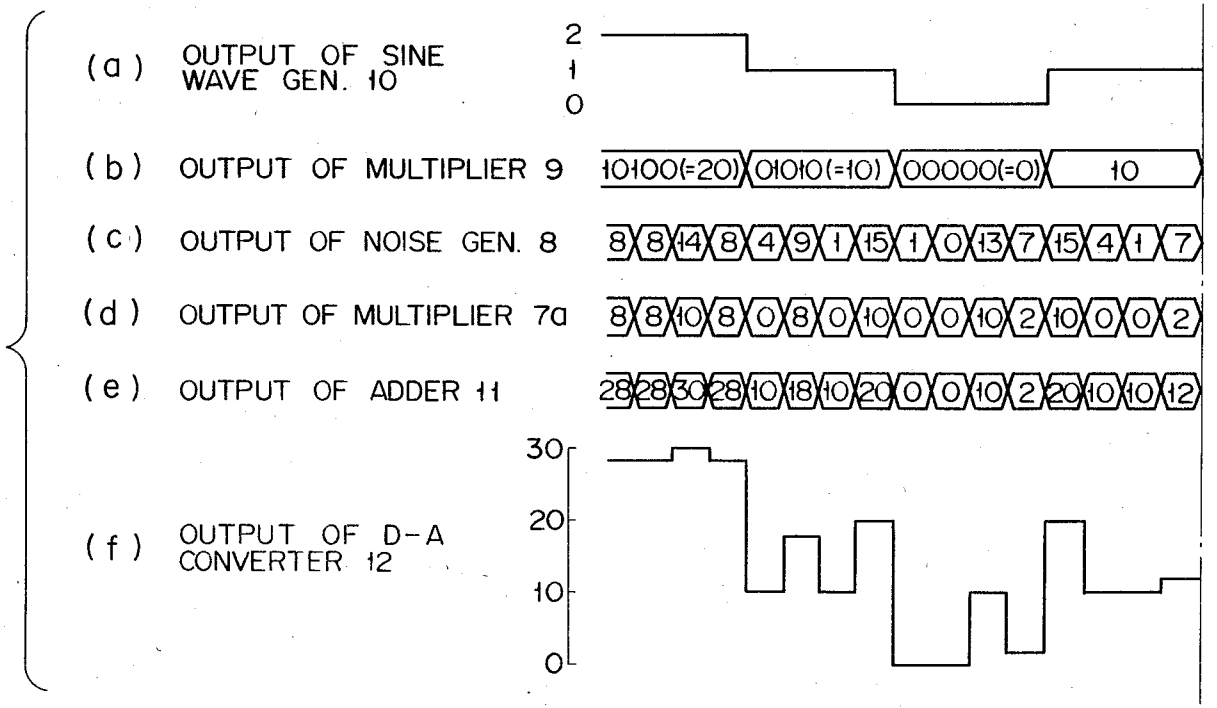
FIGS. 9A and 9B are timing charts for explaining the operation of the rhythm generating apparatus according to the embodiment of the present invention as shown in FIG. 8.
Figure 9B:
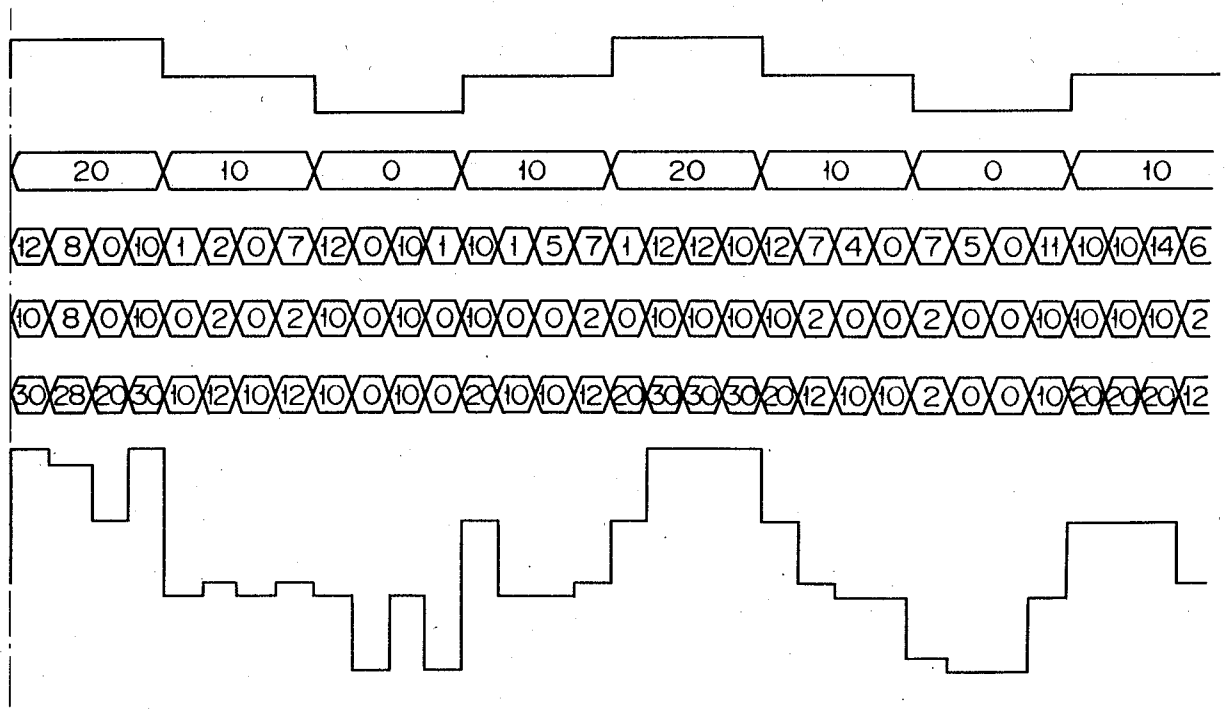

Assume that the sine wave type rhythm sound and the noise type rhythm sound are simultaneously produced. The selection signals are supplied to the sine wave generator 10 and the noise generator 8 through the lines 4-21 and 4-22. Also assume that the envelope data E4 to E1 is the binary coded data "1010" (=10 in the hexadecimal notation). Referring to FIGS. 9A and 9B, a sine wave as shown in (a) in FIGS. 9A and 9B is generated by the sine wave generator 10. This sine wave signal is illustrated as a stepwise wave signal in order to clarify the sine wave. In practice, data of 2 bits sequentially changes in the order of "10", "01", "00", "01", "10" and "01".

The output from the sine wave generator 10 is supplied to the multiplier 9 and multiplied by the output, that is, "10" from the envelope counter 6a. The multiplied result changes as shown in (b) in FIGS. 9A and 9B.

The sine wave data is defined as data of 2 bits. The multiplier performs multiplication in which the envelope data is shifted based on the sine wave data.

Simultaneoulsy, noise data of 4 bits is sequentially output from the noise generator 8, as indicated in (c) in FIGS. 9A and 9B. This noise data is supplied to the multiplier 7a shown in FIG. 4. Since envelope data is set to "1010", the AND gates 82 and 84 are ON, while the AND gates 81 and 83 are OFF.

The output from the multiplier 7a is thus changed as indicated in (d) in FIGS. 9A and 9B. The outputs from the multipliers 9 and 7a are added in the adder 11. The added data, that is, noise data added to the sine wave data, is thus obtained as shown in (e). This data is supplied to the D/A converter 12 which then generates an analog signal with a waveform shown in (f) in FIGS. 9A and 9B.

The envelope which is attenuated when the one-shot signal of level "1" is supplied from the CPU 4 through the line 4-9 is applied to the sine wave data. This sine wave data with the envelope is synthesized with the noise data. Therefore, various rhythm sounds can be produced in accordance with various modes of applying an envelope to the sine wave data and with various mixing ratios of the sine wave data to the noise data.

In order to produce only the sine wave type rhythm sound, the selection signal is supplied from the CPU 4 through the line 4-21. On the other hand, in order to produce only the noise type rhythm sound, the selection signal is produced from the CPU 4 through the line 4-22.

In the above embodiment, the envelopes of two kinds of rhythm sound data, that is, the sine wave type rhythm data and the noise type rhythm data, are controlled by the output from the single envelope counter 6a. However, the envelopes of a plurality of other rhythm sound source data such as the triangular wave data, the saw-tooth wave data, the rectangular wave data, and the pulse wave data may be controlled by a single envelope counter.

A single envelope generating circuit is commonly used for a plurality of rhythm generating systems in the embodiment described above. Thus, the circuit space can be decreased and the apparatus thereof can be manufactured in an LSI at low cost.

Figure 10:
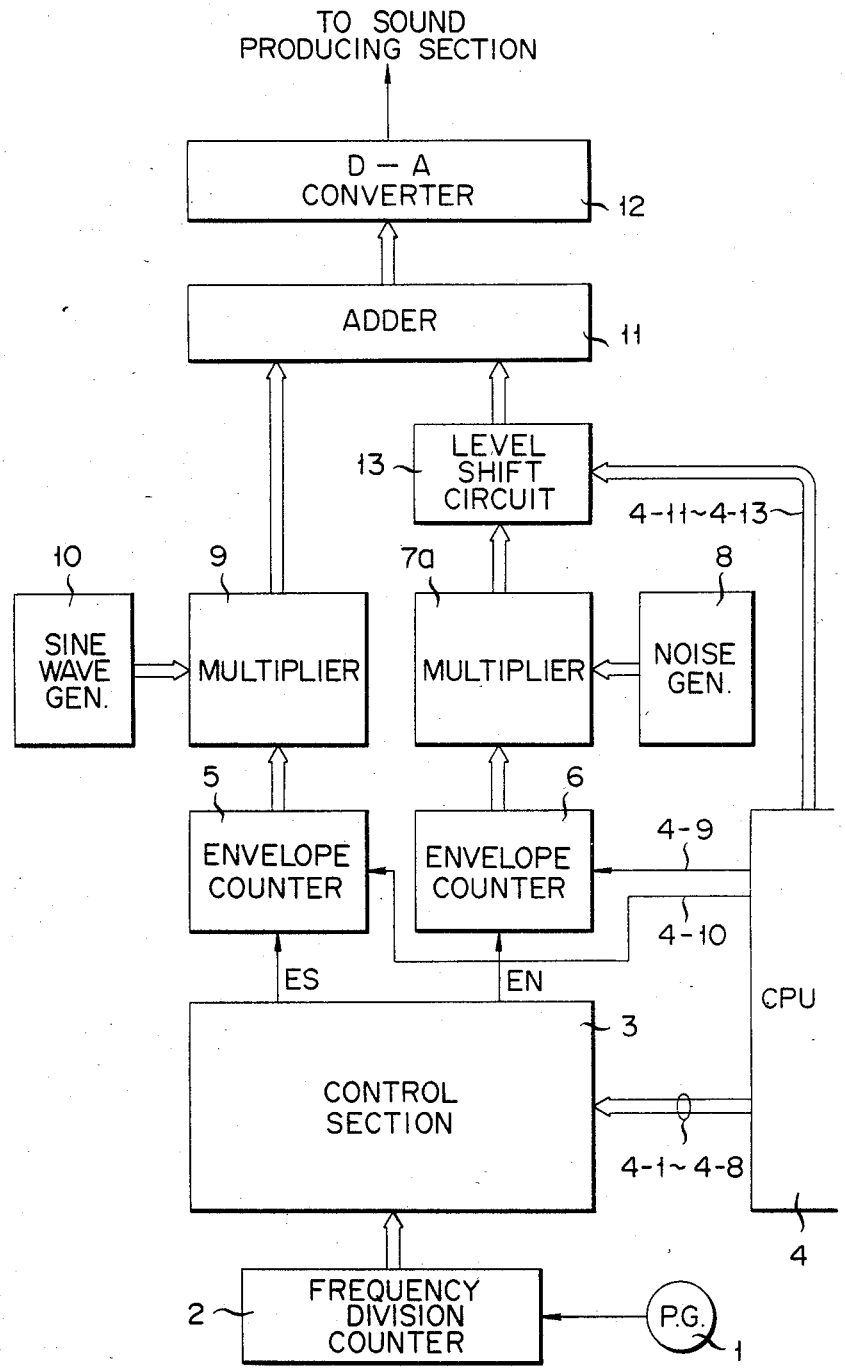
FIG. 10 is a block diagram of a rhythm generating apparatus according to still another embodiment of the present invention.
Figure 11:
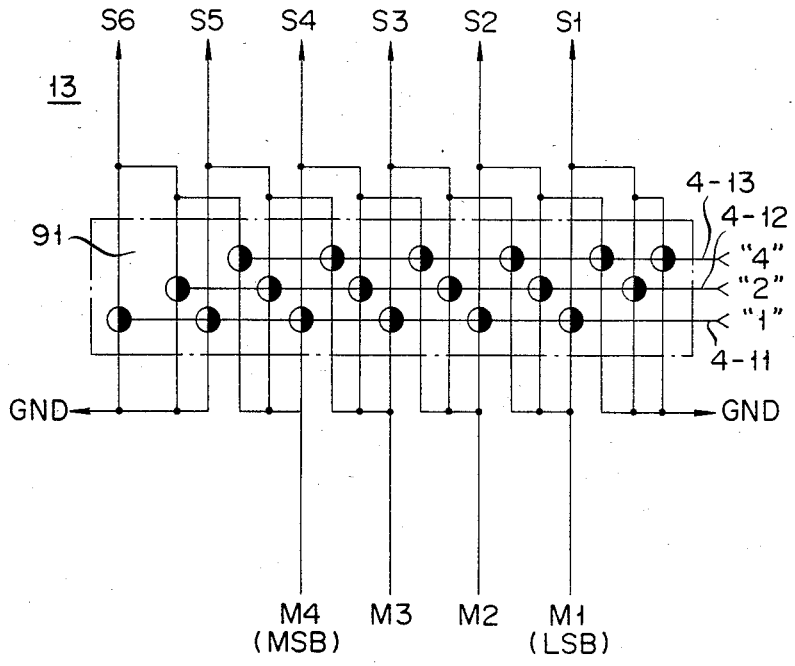
FIG. 11 is a circuit, diagram of a level shift circuit shown in FIG. 10.

FIG. 10 shows a rhythm generating apparatus according to a third embodiment of the present invention. The same or like reference numerals as in FIGS. 1 and 8 denote the corresponding parts in FIG. 10. The rhythm generating apparatus according to the third embodiment is the same as that according to the first embodiment except that the output from the multiplier 7a is amplified in a level shift circuit 13 and then supplied to the adder 11. The level shift circuit 13 is arranged in a manner as shown in FIG. 11. The multiplier 7a is the same as that in FIG. 4. The output signals M1 to M4 from the AND gates 81 to 84 correspond to M1 to M4 in FIG. 11.

The binary coded output (amplitude data of the noise type data the envelope of which is controlled) from the multiplier 7a is shifted by a predetermined number of bits by the level shift circuit 13. The amplitude data which may be multiplied at the circuit 13 acting as an amplifier by one, two or four is supplied to the adder 11. Referring to FIG. 11, data M1 to M4 supplied to a group of gate circuits 91 are the same as the amplitude data from the multiplier 7a. A signal of level "1" is supplied from the CPU 4 to the group of gate circuits 91 through one of the lines 4-11, 4-12 and 4-13. If the signal of level "1" is supplied to the gate circuits 91 only through the line 4-11, the data M1 to the M4 correspond to lower four significant bits S1 to S4 of the 6-bit data S1 to S6 generated from the gate circuits 91. The upper two significant-bit data S5 and S6 are set to level "0" or connected to GND. As a result, the data S1 to S6 supplied to the adder 11 are the same as the data M1 to M4 (multiplied by one). If the signal of level "1" is supplied only through the line 4-12, the data M1 to M4 are shifted by one bit toward the upper bit and correspond to data S2 to S5. The data S1 and S6 are set to "0" level. As a result, the data M1 to M4 are doubled as the data S1 to S6 and supplied to the adder 11. Further, if the signal of level "1" is supplied only through the line 4-13, the data M1 to M4 are shifted by two bits toward the upper bit and outputted as the data S3 to S6, while data S1 and S2 are set to level "0". As a result, the data M1 to M4 are multiplied by four and supplied as the data S1 to S6 to the adder 11.

The outputs from the multiplier 9 and the level shift circuit 13 are added in the adder 11 and supplied to the D/A converter 12. The signal is converted to an analog signal and supplied to an amplifier (not shown) and a speaker (not shown).

The mode of operation of the rhythm generating apparatus according to the third embodiment of the present invention will be described.

Figure 12A:
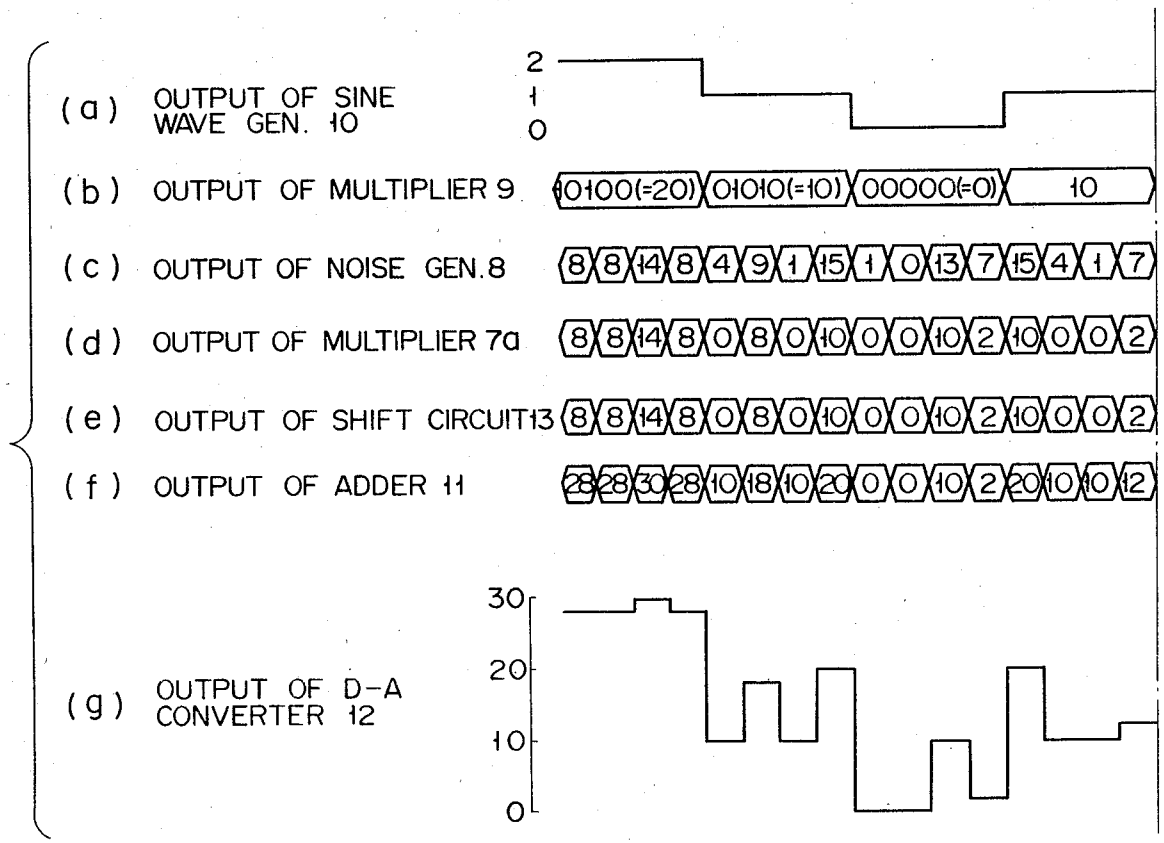
Figure 12B:
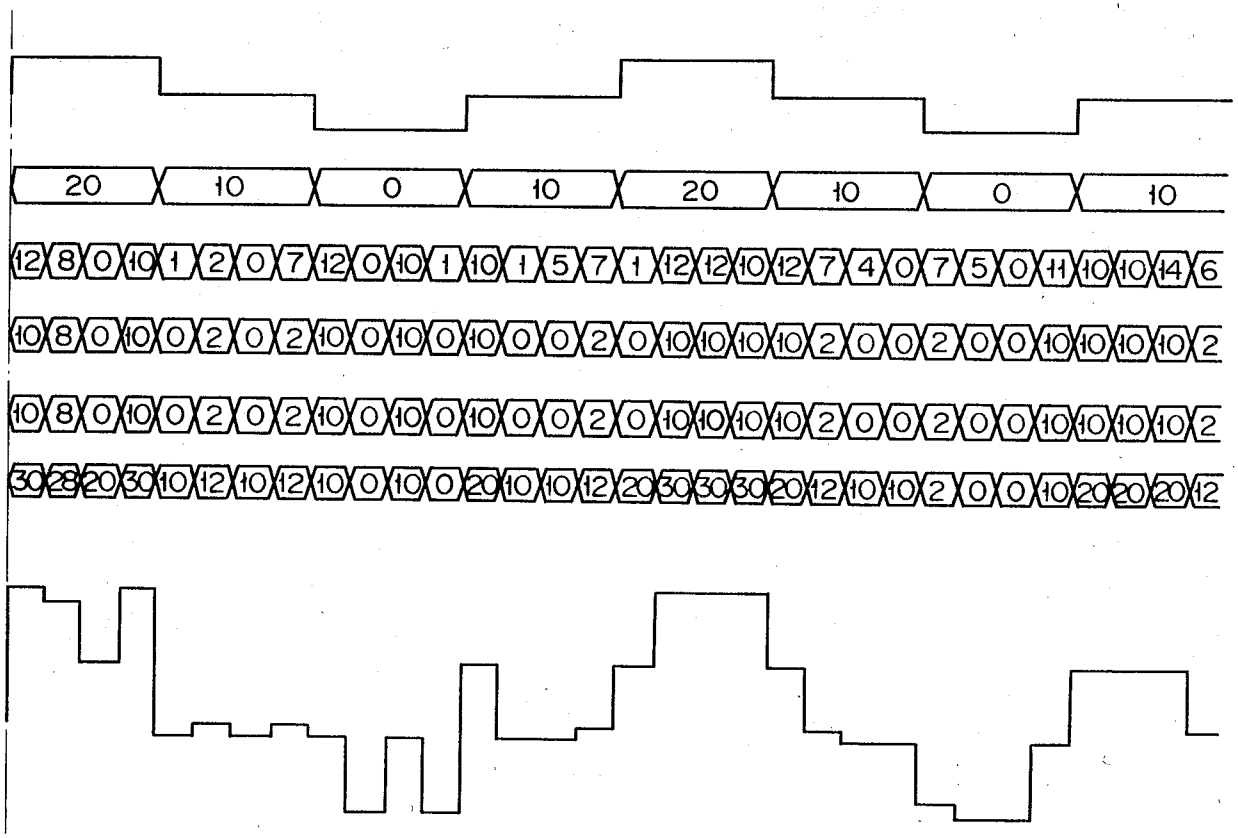

In order to simplify the description, assume that the envelope counters 5 and 6 are operated in the same manner. Further, assume that the envelope data (E4 to E1) is set to binary coded data "1010" (=10 in the hexadecimal notation) and that a signal of level "1" is supplied to the level shift circuit 13 through the line 4-11 and the signals of level "0" are supplied thereto through the lines 4-12 and 4-13. Referring to FIGS. 12A and 12B, a sine wave as shown in (a) is generated from the sine wave generator 10. The wave is illustrated in (a) to have a stepwise waveform. However, in practice, data of 2 bits is sequentially changed in the order of "10", "01", "00", "01", "10" and "01".

The output from the sine wave generator 10 is supplied to the multiplier 9 and multiplied therein by the binary coded output "10" from the envelope counter 5. The multiplied result is changed as indicated in (b) in FIGS. 12A and 12B.

As described above, the sine wave data comprises 2-bit data. Based on this data, the envelope data is bit-shifted to multiply in the multiplier 9.

Simultaneously, noise data of 4 bits as indicated in (c) in FIGS. 12A and 12B is sequentially generated from the noise generator 8. This noise data is supplied to the multiplier 7 as shown in FIG. 4. Since envelope data is set to "1010", the AND gates 82 and 84 are ON, while the AND gates 81 and 83 are OFF.

The output (data M1 to M4) from the multiplier 7a is, therefore, changed as indicated in (d) in FIGS. 12A and 12B and supplied to the level shift circuit 13. The description of the outputs shown in (a) to (d) in FIG. 12 A is also applicable to those shown in (a) to (d) in FIG. 13 and in (a) to (d) in FIG. 14.

Since the signal of level "1" is supplied through the line 4-11, the data M1 to M4 from the multiplier 7a correspond to the data S1 to S4 from the gate circuits 91 and the data S5 and S6 are set to level "0". The data M1 to M4 are multiplied by one and supplied as the data S1 to S6 to the adder 11. The output from the level shift circuit 13 is shown in (e) in FIGS. 12A and 12B.

The outputs from the multiplier 9 and the level shift circuit 13 are added in the adder 11 which produces an output as shown in (f) in FIGS. 12A and 12B. This output is the sum of the sine wave data and the noise data. An analog signal with a waveform as shown in (g) is generated from the D/A converter 12.

The envelope, which is gradually attenuated from the time in which the one-shot signal of level "1" is supplied from the CPU 4 through the lines 4-9 and 4-10, is applied to the sine wave data. This sine wave data is then synthesized with the noise data and a desired rhythm sound is produced. In this case, the noise type rhythm sound is multiplied by one in the level shift circuit 13. In other words, the volume of the rhythm sound corresponds to a basic level.

Figure 13A:
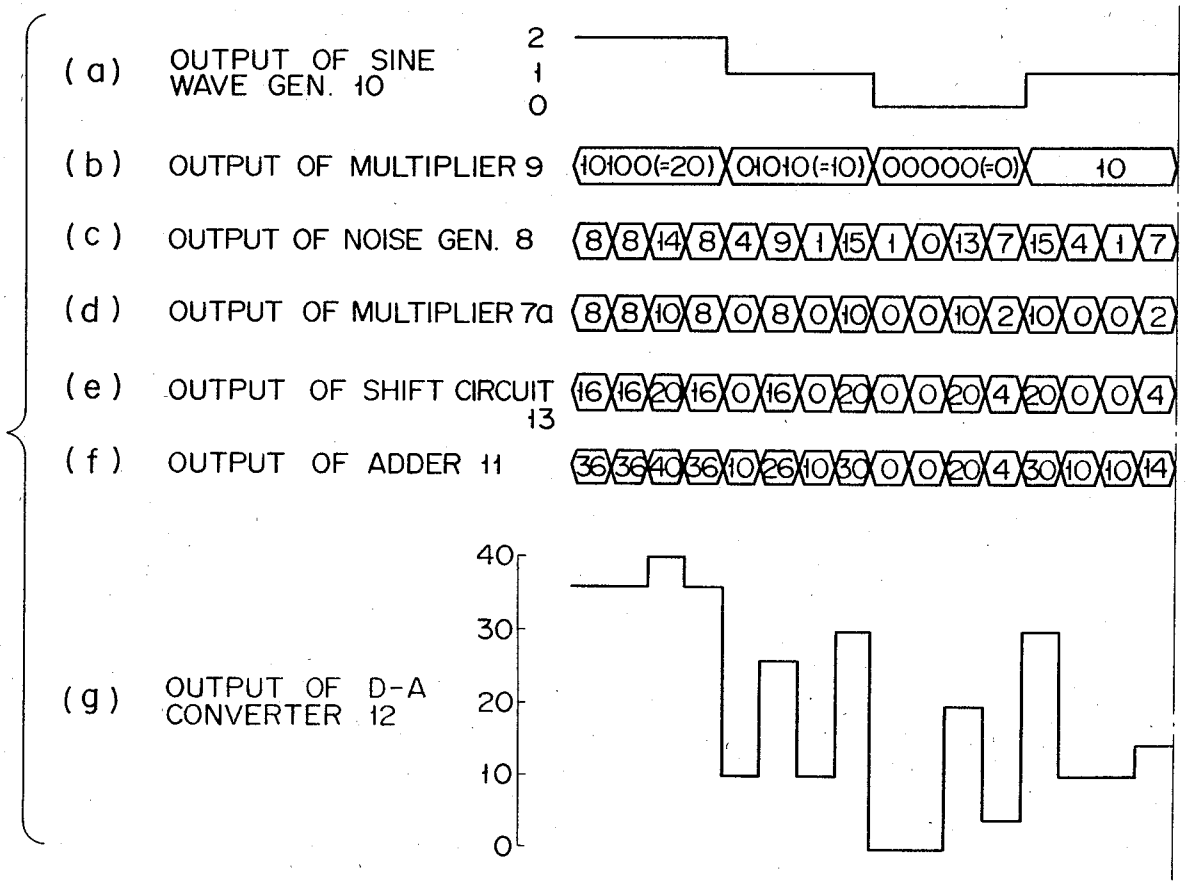
Figure 13B:
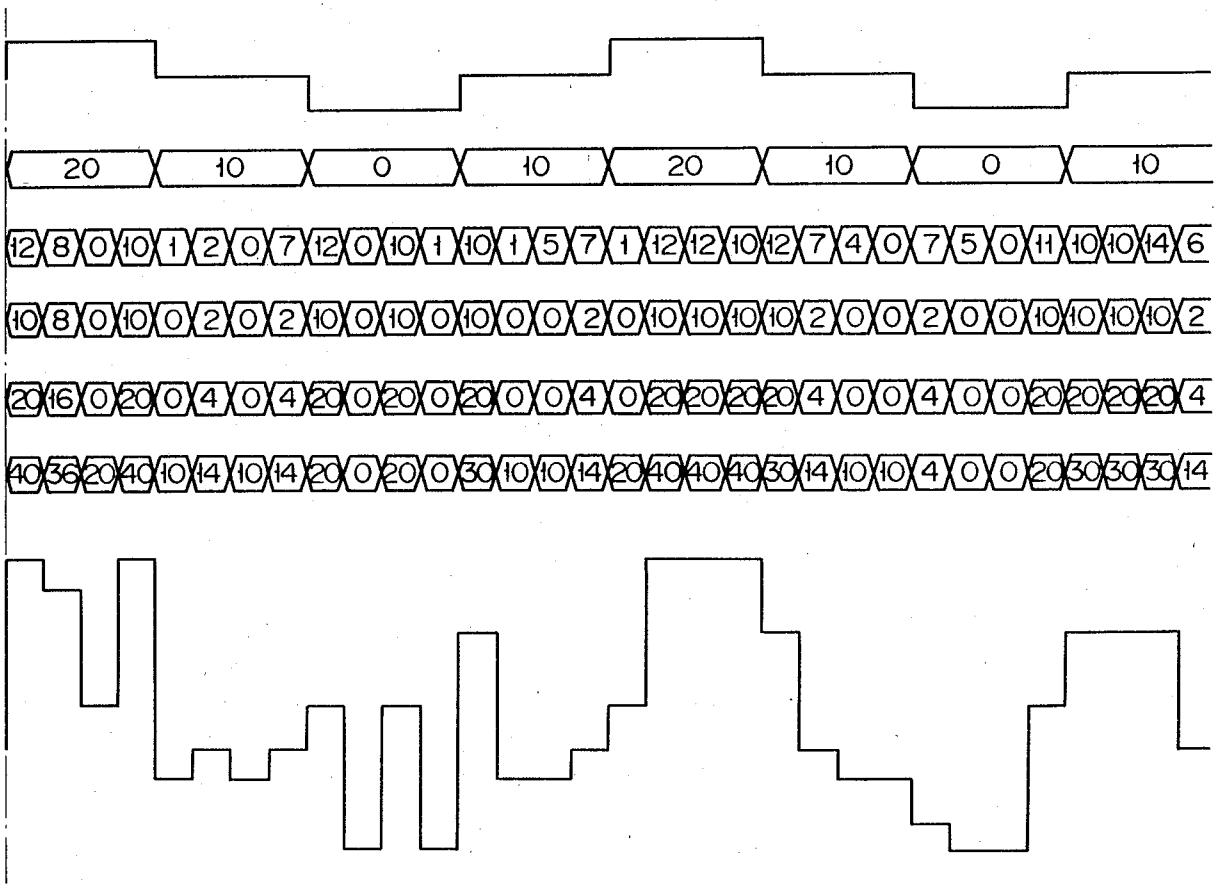

Assume now that a signal of level "1" is supplied from the CPU 4 through the line 4-12 and that signals of level "0" are supplied therefrom through the lines 4-11 and 4-13. Referring to FIGS. 13A and 13B, data M1 to M4 corresponding to the data S2 to S5 through the gate circuits 91 are supplied from the level shift circuit 13. The data M1 and M6 are set to level "0". The data M1 to M4 are shifted by one bit toward the upper bit. Therefore, the data S1 to S6 is twice the data M1 to M4. The output as shown in (e) in FIGS. 13A and 13B is twice the output as shown in (e) in FIGS. 12A and 12B. The adder 11 then produces an output as shown in (f) in FIGS. 13A and 13B. Therefore, an analog signal with a waveform as shown in (g) in FIGS. 13A and 13B is obtained. The amplitude of the noise type rhythm signal is doubled as compared with that shown in FIGS. 12A and 12B. Thus, the volume of the rhythm sound is doubled.

Figure 14A:
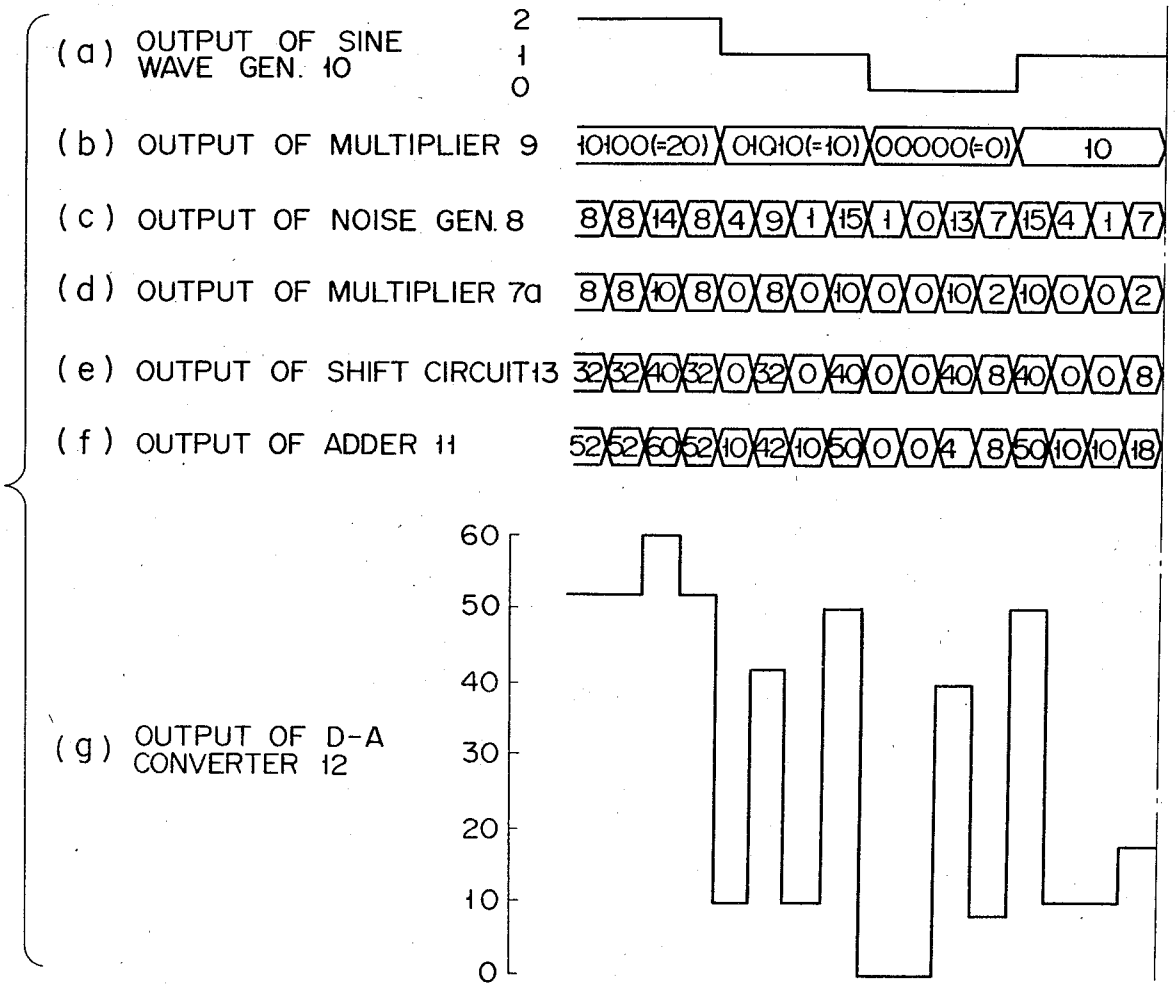
Figure 14B:
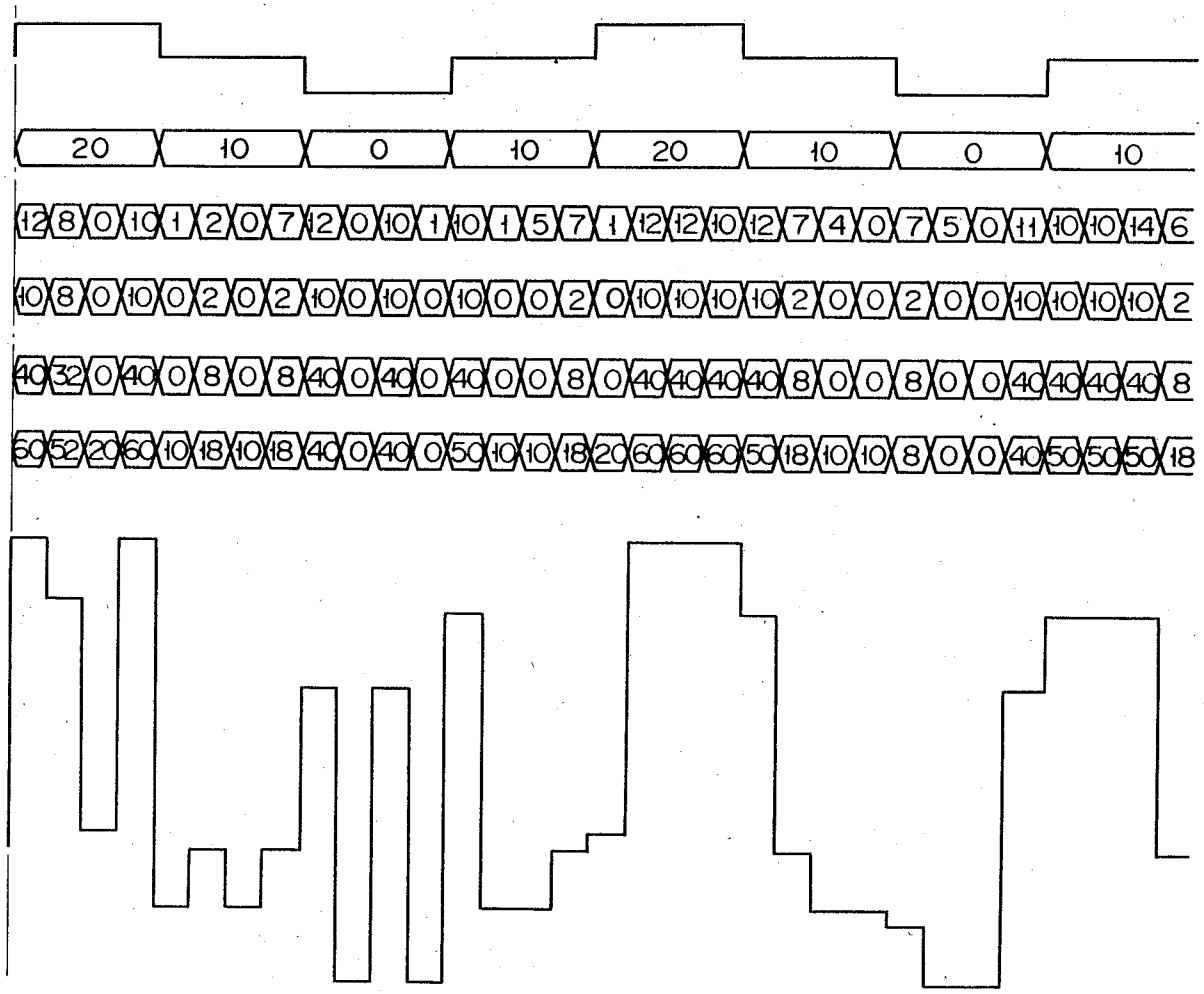

Assume that a signal of level "1" is supplied from the CPU 4 through the line 4-13 and that signals of level "0" are supplied therefrom through the lines 4-11 and 4-12. Referring to FIGS. 14A and 14B, the data M1 to M4 are outputted as the data S3 to S6 through the gate circuits 91 from the level shift circuit 13. The data S1 and S2 are set to level "0". The data M1 to M4 are shifted by two bits toward the upper bit in the level shift circuit 13. As a result, the data S1 to S6 are four times the data M1 to M4. The level shift circuit 13 produces an output as shown in (e) in FIGS. 14A and 14B. This output shown in FIGS. 14A and 14B is four times the output shown in (e) in FIGS. 12A and 12B. Therefore, the adder 11 produces an output as shown in (f) in FIGS. 14A and 14B and an analog signal with a waveform is obtained, as shown in (g) in FIGS. 14A and 14B. The amplitude of the noise type rhythm signal is multiplied by four and the volume of the rhythm sound is thus four times the basic level of the volume.

Various rhythm sounds can be produced at a prescribed volume in accordance with various applications of the envelope to the sine wave data, with various mixing ratios of the sine wave data to the noise data and with various amounts of shift in the level shift circuit 13.

In the above embodiments, the level shift circuit 13 is arranged only in the noise type sound generator. However, a level shift circuit may be arranged in the sine wave type sound generator. In this case, the volume ratio of the sine wave type sound to the noise type sound can be varied. Further, a conventional digital multiplier may be used in place of the level shift circuit. In this case, various pieces of multiplication data may be supplied from the CPU to the digital multiplier. In the above embodiment, the level shift circuit 13 is provided on the output side of the multiplier 7*a*. However, the level shift circuit 13 may be arranged on the input side of the multiplier 7*a*. This kind of arrangement can also be applied to the digital multiplier.

In the above embodiment, the two envelope counters 5 and 6 are provided to independently apply envelopes to the sine wave data and the noise data. However, as shown in the embodiment of FIG. 8, a single envelope counter may be arranged commonly to control the envelope of these data. In this case, a gate circuit for determining the mixing ratio of the noise data to the sine wave data may be added.

Further, in the above embodiment, two different rhythm sounds are simultaneously produced. However, a plurality of rhythm sounds may be produced by controlling the circuit shown in FIG. 1 on a time division basis. Further, the waveform data need not be limited to the sine wave data. The waveform data may include saw-toothed wave data, square wave data, pulse wave data and the like. The number of pieces of waveform data may be arbitrarily determined, if a plurality of waveform data is used.

In the above embodiment, the volume ratio of a plurality of rhythm sounds produced by a digital circuit system is varied by the digital circuit, while the volume of a plurality of rhythm sounds in the conventional apparatus is constant. Therefore, the first beat may be accented while the second, third and fourth beats are weakened in four-four (4/4) time. Thus, a more natural performance can be achieved.

What is claimed is:

1. A rhythm generating apparatus for an electronic musical instrument, comprising:

envelope data generating means for generating digital rhythm envelope data;

means coupled to said envelope data generating means for generating a plurality of different kinds of digital rhythm sound source waveform data in response to the envelope data generated from said envelope data generating means, and for outputting amplitude data the envelope of which is controlled;

amplifying means provided for at least one of said plurality of different kinds of rhythm sound source waveform data, said amplifying means having a variable amplification factor and being arranged to digitally amplify a selected one of said amplitude data and said envelope data; and means for synthesizing selectively each of said plurality of different kinds of rhythm sound source waveform data as envelope-controlled and amplified by said amplifying means, and for generating digital composite rhythm sound data, said amplification factor of said amplifying means being varied so that the volume ratio of said plurality of different kinds of rhythm sound source data is correspondingly varied.

2. An apparatus according to claim 6, wherein said amplifying means comprises a level shift circuit for shifting the amplitude data by predetermined bits and for supplying shifted data to said synthesizing means.

3. An apparatus according to claim 1, wherein said amplifying means comprises a digital multiplier for digitally multiplying multiplication data by the amplitude data and for supplying corresponding product data to said synthesizing means.

4. An apparatus according to claim 1, wherein said envelope data generating means is arranged to generate envelope data amplitude of which is attenuated, and said envelope controlling means is arranged to control the envelope of each of the plurality of different kinds of digital rhythm sound source waveform data.

5. A rhythm generating apparatus for an electronic musical instrument, comprising:

means for generating a plurality of different kinds of digital rhythm sound source waveform data including periodic function data and noise data, envelope data generating means including a one-shot circuit (60), logic gates (64–67) each having one input terminal to which an output of said one-shot circuit is supplied, a latch (68) for latching outputs of said logic gates (64–67) and a subtraction means (69–71) for subtracting a value from an output of said latch, an output of said subtraction means being supplied to another input terminal of said logic gates, and for generating a single kind of digital envelope data, envelope controlling means for controlling the envelope of the plurality of different kinds of rhythm sound source waveform data in response to the envelope data generated by said envelope data generating means, and means for synthesizing the plurality of different kinds of rhythm sound source waveform data the envelope of which is controlled by said envelope controlling means so that said synthesizing means generates digital rhythm sound data.

6. An apparatus according to claim 5, wherein said envelope data generating means is arranged to generate envelope data the amplitude of which is attenuated to correspond to an attenuated envelope, and said envelope controlling means simultaneously controls the envelope of each of the plurality of different kinds of rhythm sound source waveform data in accordance with said attenuated envelope.

7. A rhythm generating apparatus for an electronic musical instrument, comprising:

noise data generating means for generating digital noise data, for providing a rhythm sound source;

rhythm envelope data generating means for generating digital rhythm envelop data; and a gate circuit comprising digital logic gates directly receiving the digital noise data as one set of gate inputs from said noise data generating means and directly receiving the digital rhythm envelope data as another set of gate inputs from said rhythm envelope data generating means, for applying a rhythm envelope corresponding to said rhythm envelop data to the noise data to prpduce digital noise sound data, wherein the rhythm envelope of the sound data is controlled according to said digital rhythm envelope data without using a multiplier to multiply said digital noise data and said digital rhythm envelope data;

said rhythm envelope data generating means being arranged to generate digital envelope data the amplitude of which is gradually attenuated to correspond to an attenuated envelope, and said gate circuit being arranged to apply a rhythm envelope having said attenuated envelope to the noise data; and said gate circuit including a plurality of gates the number of which corresponds to the number of bits of said digital rhythm envelope data, each of said bits being given with a predetermined weighting value of constituting said digital rhythm envelope data, and each of the plurality of gates having a first input terminal connected to receive respective ones of said bits and having a second input terminal connected to receive respective bits of said digital noise data.

* * * * *

UNITED STATES PATENT AND TRADEMARK OFFICE

CERTIFICATE OF CORRECTION

PATENT NO. : 4,586,416

DATED : May 6, 1986

INVENTOR(S) : Shigenori MORIKAWA

It is certified that error appears in the above-identified patent and that said Letters Patent is hereby corrected as shown below:

IN THE TITLE PAGE:

Under "Inventor", change inventor's name to

--Shigenori MORIKAWA--;

COLUMN 10, line 60 (claim 2), "to claim 6" should read

--to claim 1--;

COLUMN 11, line 3 (claim 4), "the" should have been inserted after "data";

COLUMN 12, line 16 (claim 7), "prpduce" should read

--produce--.

Signed and Sealed this

Fourteenth Day of October, 1986

[SEAL]

*Attest:*

DONALD J. QUIGG

*Attesting Officer*

*Commissioner of Patents and Trademarks*